US008820755B1

(12) United States Patent
Whiteside et al.

(10) Patent No.: US 8,820,755 B1
(45) Date of Patent: Sep. 2, 2014

(54) MECHANIC'S CREEPER

(71) Applicant: Whiteside Mfg. Co., Delaware, OH (US)

(72) Inventors: Kirt E. Whiteside, Marion, OH (US); Shane Obitts, Elyria, OH (US)

(73) Assignee: Whiteside Mfg. Co., Delaware, OH (US)

( * ) Notice: Subject to any disclaimer, the term of this patent is extended or adjusted under 35 U.S.C. 154(b) by 0 days.

(21) Appl. No.: 13/773,225

(22) Filed: Feb. 21, 2013

(51) Int. Cl.
*B25H 5/00* (2006.01)

(52) U.S. Cl.
CPC ..... *B25H 5/00* (2013.01)
USPC ..... 280/32.6; 280/47.34; 280/79.11

(58) Field of Classification Search
USPC ..... 280/32.5, 32.6, 79.11, 79.2, 47.34
See application file for complete search history.

(56) References Cited

U.S. PATENT DOCUMENTS 6,345,828 B1 2/2002 Pool et al.
D469,592 S * 1/2003 Brimhall et al. ..... D34/23
7,293,783 B2 * 11/2007 Whiteside et al. ..... 280/32.6
7,712,750 B2 * 5/2010 Whiteside et al. ..... 280/32.6
2005/0275173 A1 * 12/2005 Hernandez et al. ..... 280/32.6
2006/0237922 A1 * 10/2006 Forbis ..... 280/32.6

* cited by examiner

*Primary Examiner* — John Walters
(74) *Attorney, Agent, or Firm* — Renner, Kenner, Greive, Bobak, Taylor & Weber

(57) ABSTRACT

A creeper (20) for a mechanic includes a top surface (21) and a bottom surface (22). The top surface (21) includes a headrest section (30), a shoulder-receiving section (31), a back-receiving section (32), and a buttocks-receiving section (33). The shoulder-receiving section (31) is wider than any of the other sections for comfortable full shoulder support of the user. The back-receiving section (32) and the buttocks-receiving section (33) are generally flat and the shoulder-receiving section (31) is generally uniformly inclined from the back-receiving section (32) upwardly to the headrest section (30) for the comfort of the neck of the user.
Pockets (39) are formed on each side of the buttocks-receiving section (33), and radiused surfaces (41) extend from the side surfaces of the buttocks-receiving section (33) to the pockets (39) for the comfort of the user. The bottom surface (22) includes a plurality of parallel recesses (47) extending under all of the sections of the top surface (21). The bottom surface (22) also includes a plurality of caster receiving pockets (46) which allow the complete rotation of caster assemblies (42) positioned therein.

33 Claims, 6 Drawing Sheets

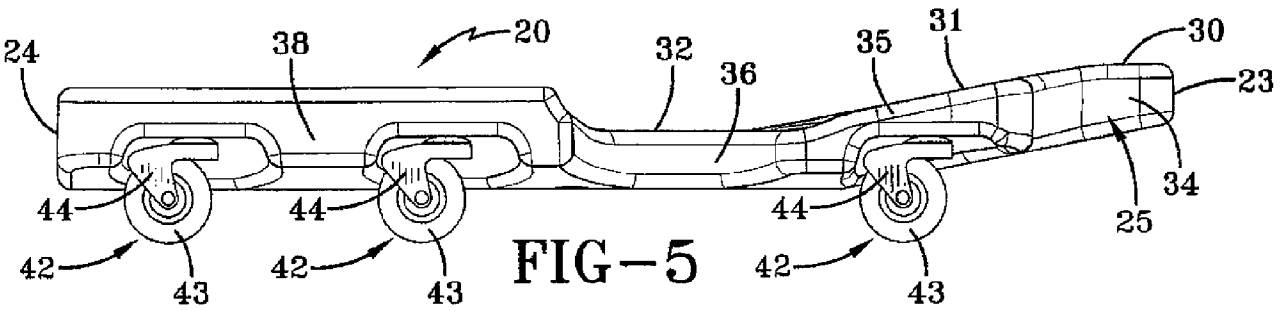
FIG-5
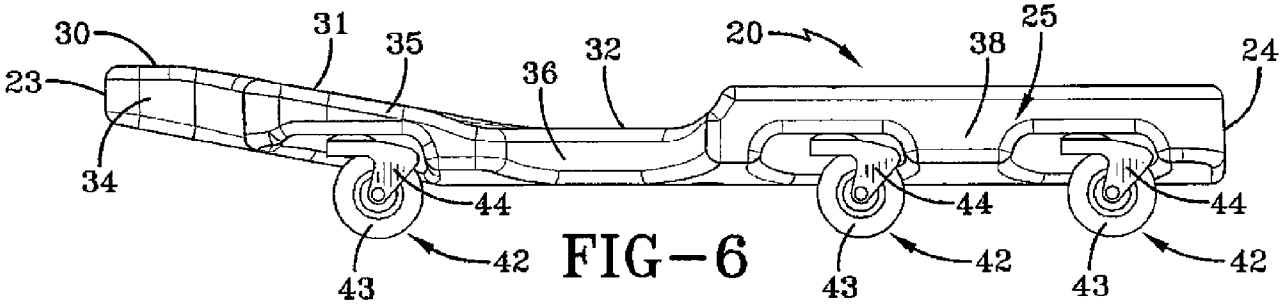
FIG-6
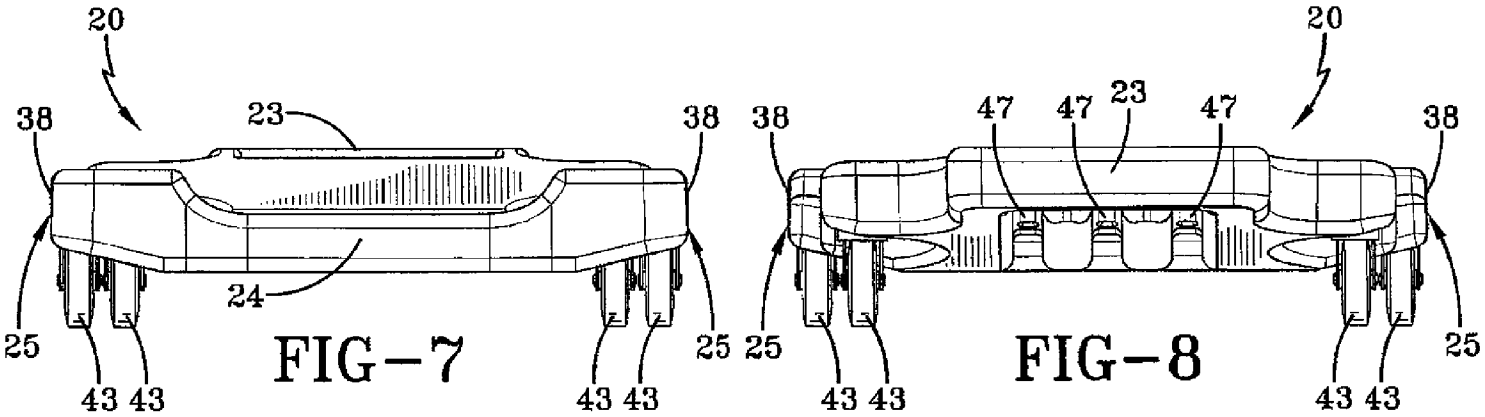
FIG-7
FIG-8

MECHANIC'S CREEPER

TECHNICAL FIELD

This invention relates to a mechanic's creeper. More specifically, this invention relates to a creeper which includes a plastic frame which is shaped to provide comfort to the user.

BACKGROUND ART

Most current creepers for use primarily by mechanics include longitudinally extending metallic rails which carry the casters and which have metallic cross members extending between them. A flat pad is positioned on the cross members to support the user. At times, a thickened area of the pad is provided at one end of the pad which is intended to be a headrest for the user.

These types of creepers have often proven to be uncomfortable to the user. Not only does the flat pad not provide comfortable full body support, but also oftentimes the shoulders of the user will extend outside the pad and uncomfortably over the metallic side rails. Moreover, the abrupt increase of thickness of the pad at the area of the head of the user oftentimes places a strain on the neck of a user. Many creepers are provided with pockets to carry tools and such usually define a sharp transition between the body of the creeper and the pockets resulting in discomfort to the user.

Finally, essentially all creepers are rendered mobile by a plurality of caster assemblies which are typically evenly spaced along the metallic frame. However, such spacing does not always take into consideration where the most significant weight of the user is located. Moreover, in order to provide complete swiveling of the casters, the height of the creeper is increased thereby rendering the creeper more difficult to use in height confined areas.

Attempts to solve these problems without a significant increase in cost have not proven successful. Thus, the need exists for a creeper which comfortably cradles the entire upper body of the user, and one which is rendered completely mobile without a comprise to the height of the creeper.

DISCLOSURE OF THE INVENTION

It is thus an object of one aspect of the present invention to provide a creeper with a contoured plastic frame.

It is an object of another aspect of the present invention to provide a creeper, as above, with an integral headrest which is uniformly inclined upwardly from the main body of the creeper.

It is an object of a further object of the present invention to provide a creeper, as above, which provides full shoulder support.

It is an object of an additional aspect of the present invention to provide a creeper, as above, which cradles the body of the user at the end opposite to the headrest.

It is an object of yet another aspect of the present invention to provide a creeper, as above, which includes tool pockets that assist in cradling the body of the user.

It is an object of still another aspect of the present invention to provide a creeper, as above, with caster assemblies properly distributed on the creeper for weight distribution and located in pockets so as to provide complete mobility and a better profile for the creeper.

These and other objects of the present invention, as well as the advantages thereof over existing prior art forms, which will become apparent from the description to follow, are accomplished by the improvements hereinafter described and claimed.

In general, a creeper made in accordance with one aspect of the invention includes a top surface and a bottom surface. The top surface includes a headrest section, a shoulder-receiving section adjacent to the headrest section, a back-receiving section adjacent to the shoulder-receiving section, and a buttocks-receiving section adjacent to the back-receiving section. The back-receiving section and the buttocks-receiving section are generally flat, and the shoulder-receiving section is generally uniformly inclined from the back-receiving section upwardly to the headrest section.

In accordance with another aspect of the invention, a creeper includes a top surface and a bottom surface. The top surface includes a headrest section, a shoulder-receiving section adjacent to the headrest section, a back-receiving section adjacent to the shoulder-receiving section, and a buttocks-receiving section adjacent to the back-receiving section. A pocket is formed at each side of the buttocks-receiving section, and a radiused surface extends upwardly from each side of the buttocks-receiving section to the pockets.

In an additional aspect of the invention, a creeper includes a top surface and a bottom surface. The top surface includes a headrest section, a shoulder-receiving section adjacent to the headrest section, a back-receiving section adjacent to the shoulder-receiving section, and a buttocks-receiving section adjacent to the back-receiving section. The shoulder-receiving section is wider than any of the other sections.

As another aspect of the invention, a creeper includes a top surface and a bottom surface. A plurality of pockets are formed in the bottom surface and a caster assembly is positioned in each pocket. The pockets are configured to permit the rotation of each caster assembly within the bottom surface and under the top surface.

Thus, a creeper made in accordance with the aspects of this invention includes a creeper having a top surface and a bottom surface. The top surface includes a headrest section, a shoulder-receiving section adjacent to the headrest section, a back-receiving section adjacent to the shoulder-receiving section, and a buttocks-receiving section adjacent to the back-receiving section. The back-receiving section and the buttocks-receiving section are generally flat. The shoulder-receiving section is wider than any of the other sections and is generally uniformly inclined from the back-receiving section upwardly to the headrest section. A pocket is formed at each side of the buttocks-receiving section, and a radiused surface extends upwardly from each side of the buttocks-receiving section to the pockets. A plurality of pockets are formed in the bottom surface and a caster assembly is positioned in each of the bottom surface pockets. These pockets are configured to permit the full rotation of each caster assembly within the bottom surface and under the top surface.

A preferred exemplary creeper made in accordance with the present invention is shown by way of example in the accompanying drawings without attempting to show all the various forms and modifications in which the invention might be embodied, the invention being measured by the appended claims and not by the details of the specification.

BRIEF DESCRIPTION OF THE DRAWINGS

FIG. 5 is a side elevational view of the creeper.

FIG. 6 is an elevational view of the side of the creeper opposite to that shown in FIG. 5.

FIG. 7 is an elevational view of the bottom end of the creeper.

FIG. 8 is an elevational view of the top, headrest, end of the creeper.

PREFERRED EMBODIMENT FOR CARRYING OUT THE INVENTION

Figure 10:
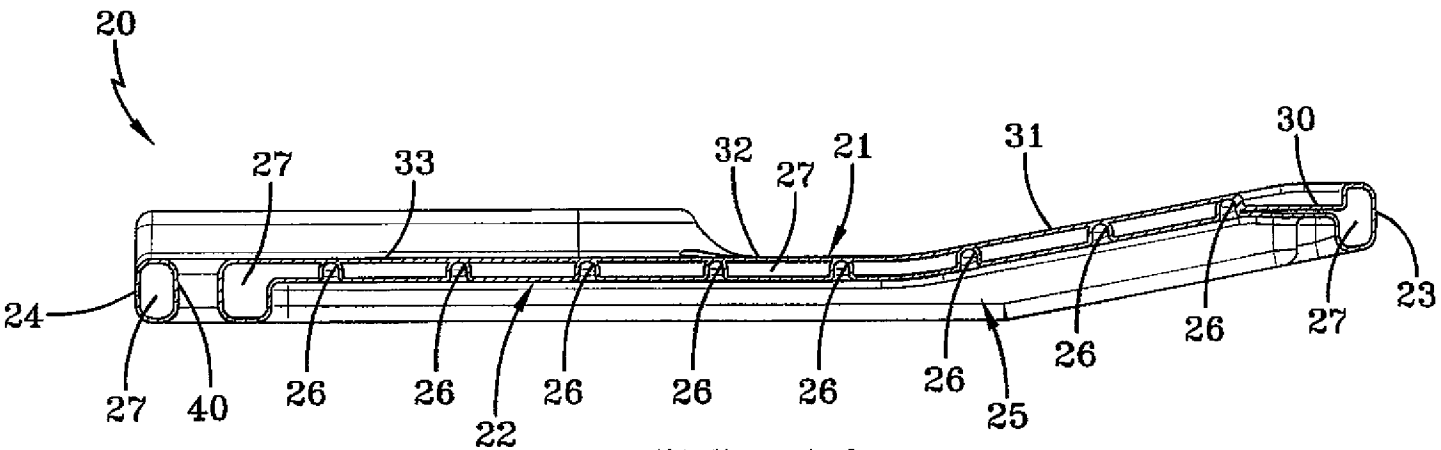
FIG. 10 is a sectional view taken substantially along line 10-10 of FIG. 3.

A mechanic's creeper made in accordance with the concepts of the present invention is generally indicated by the numeral 20 and is blow molded to form a top surface of plastic material, generally indicated by the numeral 21, and a bottom surface of plastic material generally indicated by the numeral 22. Top and bottom surfaces 21 and 22 merge together to form a creeper top edge 23, a creeper bottom edge 24, and opposed creeper side edges generally indicated by the numeral 25. Also, as shown in FIG. 10, along the length of creeper 20, the top of bottom surface 22 engages the bottom of top surface 21 at conventional "kiss off" areas 26. As a result of this configuration, creeper 10 has hollow areas 27 between top and bottom surfaces 21 and 22, yet is strong as will be hereinafter described in more detail.

The top surface 21 is formed of a plurality of areas each designed to receive a certain portion of the human body. Thus, top surface 21 includes a headrest section 30, a shoulder-receiving section 31, a back-receiving section 32 and a buttocks-receiving section 33. Headrest section 30, which may receive a pad (not shown), is defined by the top edge 23 of creeper 20 and opposed side headrest edges 34 of creeper edges 25. Edges 34 flare outwardly to form shoulder edges 35 which are significantly spaced so that shoulder-receiving section 31 is wider than headrest section 30 and large enough to provide full human shoulder support. Creeper edges 25 are arcuately recessed, as at 36, at the sides of the back-receiving section 32, and opposed arcuate apertures 37 are formed through top and bottom surfaces 21 and 22 to be used as hand holes so that creeper 20 can be carried by a user who would engage a recessed area 36 and place his fingers through an adjacent aperture 37. The arcuate or curved configuration of aperture 37 generally corresponds in shape to the arcuate recesses 36 to provide a more comfortable gripping area than if these apertures 37 were linear in orientation. At the transition between the back-receiving section 32 and the buttocks-receiving section 33, creeper edges 25 flare outwardly to form edges 38, and pockets 39 are formed at that area which may be used to store tools or the like. Edges 38 are spaced further from each other than shoulder edges 35 to define the formation of pockets 39 and for the cradling of the user between pockets 39 as will be more fully hereinafter described. The pockets 39 are not only located for the facile placement or removal of tools or the like, but also the edges of the pockets 39 at the transition of sections 32 and 33 provide a convenient surface for the user to push against when navigating creeper 10. An additional hand hole 40 may be formed at the bottom end of buttocks-receiving section 33, adjacent to bottom edge 24.

Top surface 21 of creeper 20 is generally flat at the back-receiving section 32 and the buttocks-receiving section 33. However, at generally the junction of the top of the back-receiving section 32 and the bottom of the shoulder-receiving section 31, that is, at the top edge of recessed edge 36 and apertures 37, back-receiving section 32 is totally uniformly inclined upwardly as it extends from back-receiving section 32 until it reaches headrest section 30. As a result, there is a gradual incline from the user's back to his head which comfortably receives the user's shoulders and neck.

The side edges of the surface of the top surface of the buttocks-receiving section 33 curve upwardly, as at 41, to form one edge of pockets 39. Thus, rather than an abrupt transition, these radiused surfaces 41 comfortably cradle the lower buttocks portion of the user's body.

Creeper 20 is rendered mobile by a plurality of caster assemblies generally indicated by the numeral 42. Caster assemblies 42 includes wheels 43 rotationally carried by brackets 44 which have a stem received in apertures 45 extending through top and bottom surfaces 21 and 22. One pair of caster assemblies 42 are mounted through surfaces 21 and 22 at the area of shoulder-receiving section 31, and the other two pairs of caster assemblies are mounted at the area of buttocks-receiving section 33. Such uneven spacing of the casters better distributes the weight of the user and permits more facile controlled movement of creeper 20.

Figure 1:
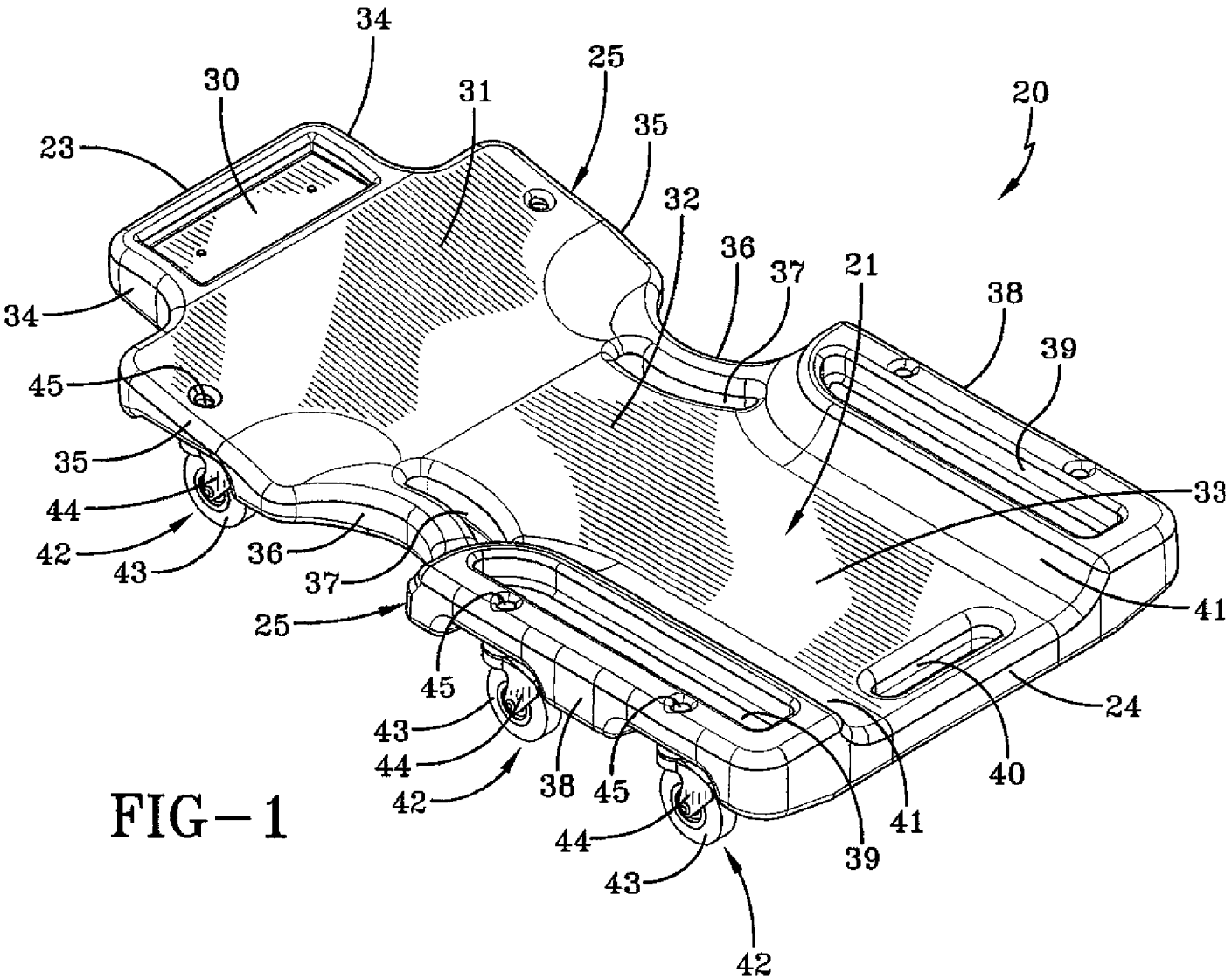
FIG. 1 is a top perspective view of a creeper made in accordance with the present invention.
Figure 2:
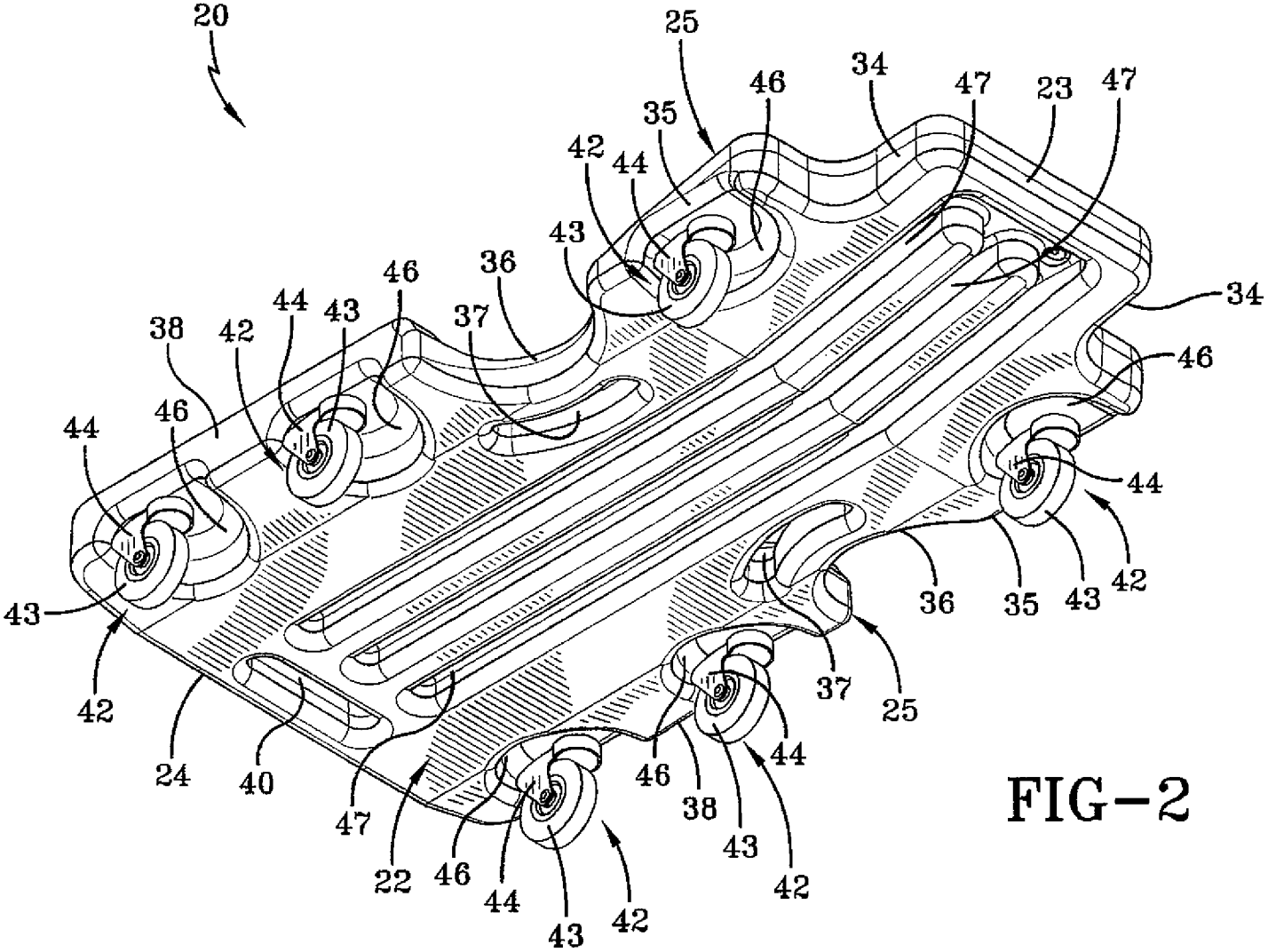
FIG. 2 is a bottom perspective view of the creeper.
Figure 3:
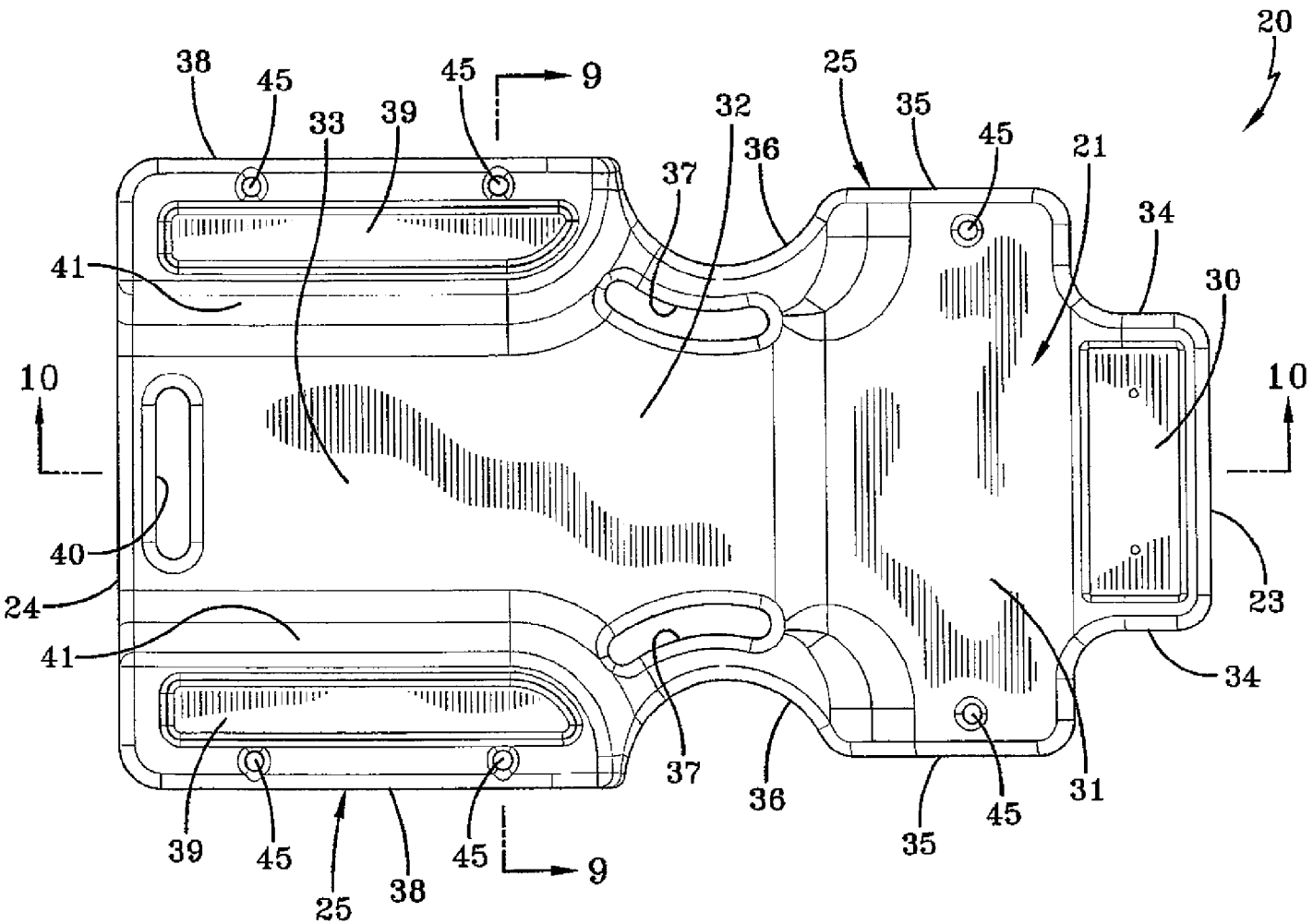
FIG. 3 is a top plan view of the creeper.
Figure 4:
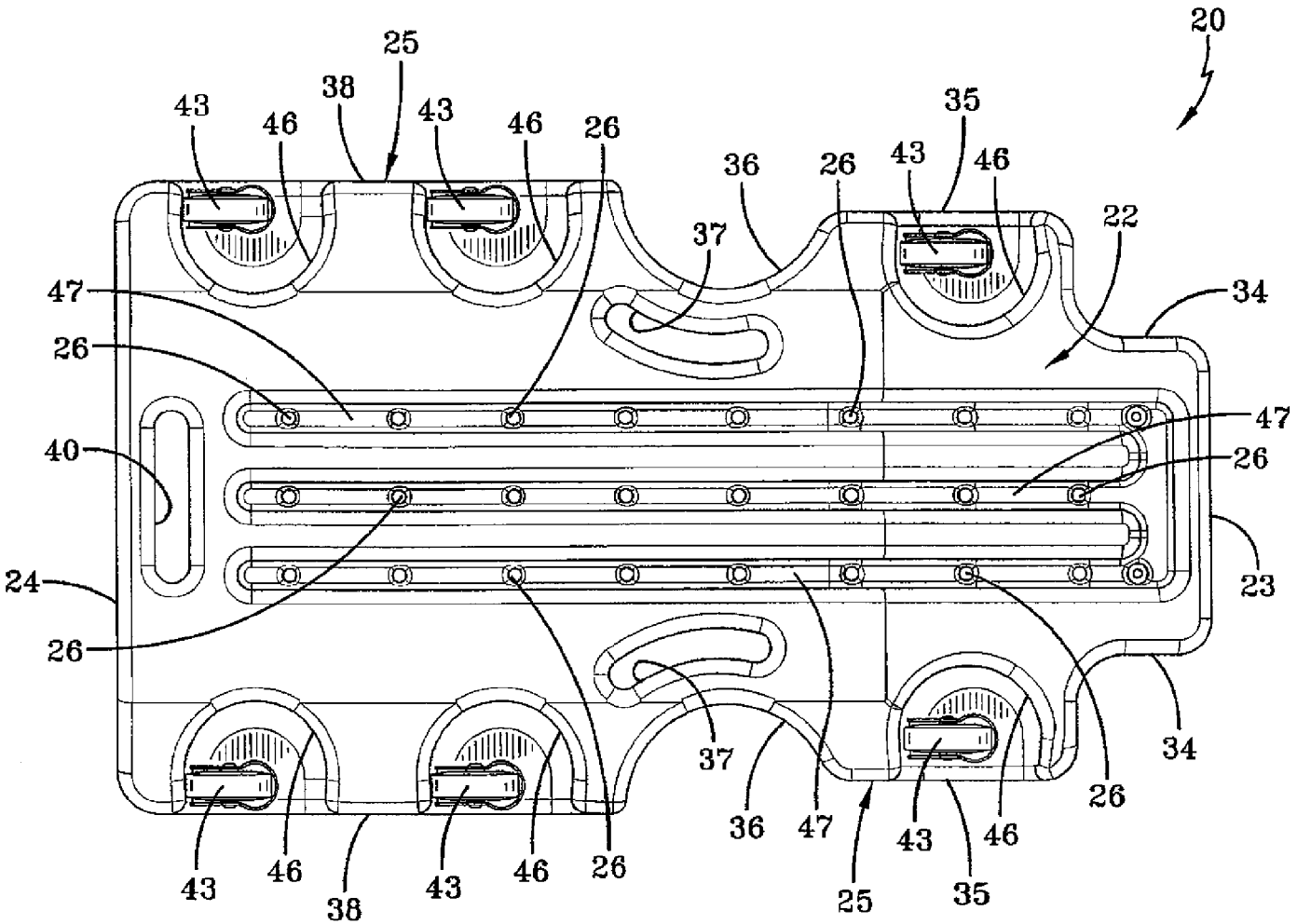
FIG. 4 is a bottom plan view of the creeper.
Figure 9:
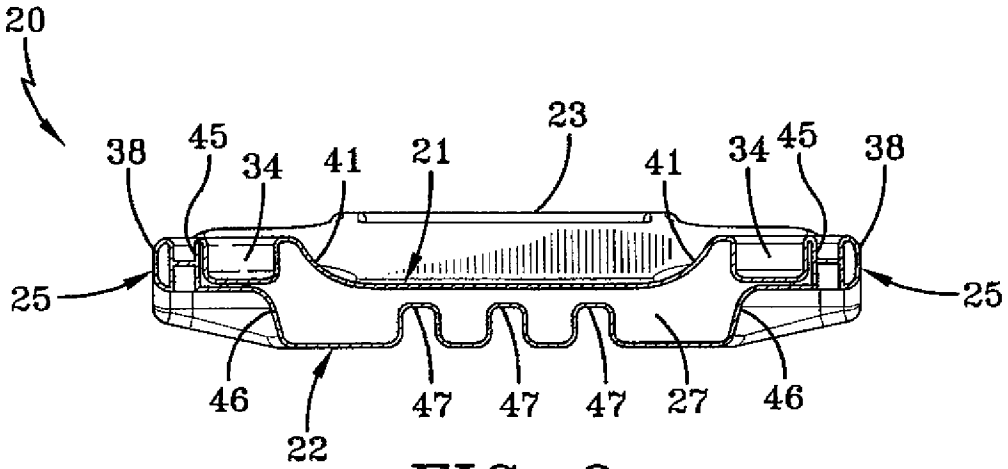
FIG. 9 is a sectional view taken substantially along line 9-9 of FIG. 3.

The bottom surface 22 of creeper 20 is best shown in FIGS. 2 and 4. A pocket 46 is provided in bottom surface 22 below upper surface 21 to receive each caster assembly 42. Each pocket 46 is configured to permit the full rotation of a caster assembly 42 within the bottom surface 22 and below the upper surface 21. Thus, as shown, a surface of each pocket 46 is generally in the form of a semi-circle sized to define the arc transcribed by a swiveling caster assembly 42. As such, the caster assemblies 42 are mounted below the profile of creeper 10 while allowing the body of creeper 10 to be positioned closer to the surface that it is positioned on.

Bottom surface 22 is also provided with three generally parallel recesses 47 are formed extending for essentially the entire length of creeper 20. Thus, recesses 47 are positioned under the headrest, shoulder-receiving, back-receiving, and buttocks-receiving sections 30, 31, 32, and 33, respectively, of top surface 21. The kiss offs 26 are located within each recess 47. This configuration adds substantial strength to creeper 20 and allows it to be economically formed of very thin top and bottom surface materials.

It should thus be evident that a creeper 20 constructed as described herein accomplishes the objects of the invention and otherwise substantially improves the art.

What is claimed is:

1. A creeper comprising a top surface and a bottom surface; said top surface including a headrest section, a shoulder-receiving section adjacent to said headrest section, a back-receiving section adjacent to said shoulder-receiving section, and a buttocks-receiving section adjacent to said back-receiving section; said back-receiving section and said buttocks-receiving section being generally flat; said shoulder-receiving section being generally uniformly inclined in its entirety from said back-receiving section upwardly to said headrest section.

2. The creeper of claim 1 further comprising a pocket formed at each side of said buttocks-receiving section; and a radiused surface extending upwardly from each side of said buttocks-receiving section to said pockets.

3. The creeper of claim 1, said shoulder-receiving section being wider than any of the other sections.

4. The creeper of claim 1 further comprising a plurality of pockets in said bottom surface and a caster assembly positioned in each said pocket, each said pocket being configured to permit rotation of each said caster assembly within said bottom surface and under said top surface.

5. The creeper of claim 1 wherein said back-receiving section has side edges which are recessed between said shoulder-receiving section and said buttocks-receiving section, and apertures extend through said top and bottom surfaces adjacent to said recessed side edges.

6. The creeper of claim 5 wherein the recessed side edges are curved and said apertures are correspondingly curved.

7. The creeper of claim 1 further comprising an aperture through said top and bottom surfaces at a end of said buttocks-receiving section opposite to said back-receiving section.

8. The creeper of claim 1 further comprising a pair of caster assemblies mounted to said top and bottom surfaces at an area of said shoulder-receiving section, and two pairs of caster assemblies mounted to said top and bottom surfaces at the area of said buttocks-receiving section.

9. The creeper of claim 1 further comprising a plurality of generally parallel recesses in said bottom surface extending under all said sections of said top surface.

10. The creeper of claim 9, said top and bottom surfaces engaging each other at spaced locations within each of said recesses.

11. A creeper comprising a top surface and a bottom surface; said top surface including a headrest section, a shoulder-receiving section adjacent to said headrest section, a back-receiving section adjacent to said shoulder-receiving section, and a buttocks-receiving section adjacent to said back-receiving section; a pocket formed at each side of said buttocks-receiving section; and a concave radiused surface extending upwardly from each side of said buttocks-receiving section to said pockets.

12. The creeper of claim 11, said shoulder-receiving section being wider than any of the other sections.

13. The creeper of claim 11 further comprising a plurality of pockets in said bottom surface and a caster assembly positioned in each said pocket, each said pocket being configured to permit rotation of each said caster assembly within said bottom surface and under said top surface.

14. The creeper of claim 11 wherein said back-receiving section has side edges which are recessed between said shoulder-receiving section and said buttocks-receiving section, and apertures extend through said top and bottom surfaces adjacent to said recessed side edges.

15. The creeper of claim 14 wherein the recessed side edges are curved and said apertures are correspondingly curved.

16. The creeper of claim 11 further comprising an aperture through said top and bottom surfaces at a end of said buttocks-receiving section opposite to said back-receiving section.

17. The creeper of claim 11 further comprising a pair of caster assemblies mounted to said top and bottom surfaces at an area of said shoulder-receiving section, and two pairs of caster assemblies mounted to said top and bottom surfaces at the area of said buttocks-receiving section.

18. The creeper of claim 11 further comprising a plurality of generally parallel recesses in said bottom surface extending under all said sections of said top surface.

19. The creeper of claim 18, said top and bottom surfaces engaging each other at spaced locations within each of said recesses.

20. A creeper comprising a top surface and a bottom surface; said top surface including a headrest section, a shoulder-receiving section adjacent to said headrest section, a back-receiving section adjacent to said shoulder-receiving section, and a buttocks-receiving section adjacent to said back-receiving section; said shoulder-receiving section being wider than any of the other sections.

21. The creeper of claim 20 further comprising a plurality of pockets in said bottom surface and a caster assembly positioned in each said pocket, each said pocket being configured to permit rotation of each said caster assembly within said bottom surface and under said top surface.

22. The creeper of claim 20 wherein said back-receiving section has side edges which are recessed between said shoulder-receiving section and said buttocks-receiving section, and apertures extend through said top and bottom surfaces adjacent to said recessed side edges.

23. The creeper of claim 22 wherein the recessed side edges are curved and said apertures are correspondingly curved.

24. The creeper of claim 20 further comprising an aperture through said top and bottom surfaces at an end of said buttocks-receiving section opposite to said back-receiving section.

25. The creeper of claim 20 further comprising a pair of caster assemblies mounted to said top and bottom surfaces at an area of said shoulder-receiving section, and two pairs of caster assemblies mounted to said top and bottom surfaces at the area of said buttocks-receiving section.

26. The creeper of claim 20 further comprising a plurality of generally parallel recesses in said bottom surface extending under all said sections of said top surface.

27. The creeper of claim 26, said top and bottom surfaces engaging each other as spaced locations within each of said recesses.

28. A creeper comprising a top surface and a bottom surface, a plurality of semi-circular pockets in said bottom surface, and a caster assembly positioned in each semi-circular pocket, each said semi-circular pocket being configured to permit the rotation of each said caster assembly within said bottom surface and under said bottom surface such that the caster assembly is within the semi-circular pocket for at least half the rotation of the caster assembly.

29. The creeper of claim 28 wherein said top surface includes a shoulder-receiving section spaced from a buttocks-receiving section, there being a pair of caster assemblies mounted to said top and bottom surfaces at an area of said shoulder-receiving section, and two pairs of caster assemblies mounted to said top and bottom surfaces at the area of said buttocks-receiving section.

30. The creeper of claim 28 further comprising a plurality of generally parallel recesses in said bottom surface extending under all said sections of said top surface.

31. The creeper of claim 28, said top and bottom surfaces engaging each other at spaced locations within each of said generally parallel recesses.

32. A creeper comprising a top surface and a bottom surface; said top surface including a headrest section, a shoulder-receiving section adjacent to said headrest section, a back-receiving section adjacent to said shoulder-receiving section, and a buttocks-receiving section adjacent to said back-receiving section; said back-receiving section and said buttocks-receiving section being generally flat; said shoulder-receiving section being wider than any of the other sections and being generally uniformly inclined in its entirety from said back-receiving section upwardly to said headrest section; a pocket formed at each side of said buttocks-receiving section; a concave radiused surface extending upwardly from each side of said buttocks-receiving section to said pockets; a plurality of semi-circular pockets formed in said bottom surface; and a caster assembly positioned in each said semi-circular bottom surface pocket; said semi-circular bottom surface pockets being configured to permit the full rotation of each caster assembly within said bottom surface and under said top surface such that the caster assembly is within the semi-circular pocket for at least half the rotation of the caster assembly.

33. A creeper comprising a top surface and a bottom surface; said top surface including a headrest section, a shoulder-receiving section adjacent to said headrest section, a back-receiving section adjacent to said shoulder-receiving section, and a buttocks-receiving section adjacent to said back-receiving section; and a plurality of generally parallel recesses in said bottom surface under all said sections of said top surface.

* * * * *